US007931424B2

(12) United States Patent
Martin, Sr.

(10) Patent No.: US 7,931,424 B2
(45) Date of Patent: Apr. 26, 2011

(54) APPARATUS AND METHOD FOR PRODUCING SOIL COLUMNS

(75) Inventor: John Paul Martin, Sr., Hillsboro, OR (US)

(73) Assignee: GeoTech Goundation Company—West, Hillsboro, OR (US)

( * ) Notice: Subject to any disclaimer, the term of this patent is extended or adjusted under 35 U.S.C. 154(b) by 176 days.

(21) Appl. No.: 12/485,825

(22) Filed: Jun. 16, 2009

(65) Prior Publication Data

US 2009/0311050 A1 Dec. 17, 2009

Related U.S. Application Data

(60) Provisional application No. 61/061,965, filed on Jun. 16, 2008.

(51) Int. Cl.
*E02D 3/02* (2006.01)

(52) U.S. Cl. ..... 405/271; 405/232; 405/233

(58) Field of Classification Search ..... 405/229, 405/231, 232, 233, 236, 240, 271
See application file for complete search history.

(56) References Cited

U.S. PATENT DOCUMENTS

| | | | | |
|---|---|---|---|---|
| 3,772,892 | A * | 11/1973 | Ogawa | 405/271 |
| 4,126,007 | A * | 11/1978 | Mars | 405/271 |
| 5,249,892 | A * | 10/1993 | Fox et al. | 405/271 |
| 6,354,766 | B1 * | 3/2002 | Fox | 405/232 |
| 7,226,246 | B2 * | 6/2007 | Fox | 405/240 |
| 7,296,475 | B2 | 11/2007 | Conner | |
| 2008/0101873 | A1 * | 5/2008 | Fox et al. | 405/239 |
| 2008/0205993 | A1 * | 8/2008 | Wissmann et al. | 405/271 |
| 2009/0317188 | A1 * | 12/2009 | Degen et al. | 405/271 |
| 2010/0028087 | A1 * | 2/2010 | Wissmann | 405/271 |

FOREIGN PATENT DOCUMENTS

| | | | |
|---|---|---|---|
| GB | 2249181 A | | 8/1991 |
| SU | 857349 | * | 9/1981 |

* cited by examiner

*Primary Examiner* — Frederick L Lagman
(74) *Attorney, Agent, or Firm* — Stoel Rives LLP

(57) ABSTRACT

A method and apparatus for constructing soil columns in-situ in the ground are disclosed for the purpose of improving the structure supporting capability of surface soils to support loads from buildings and other structures. Some embodiments use a surcharge ring or load to apply a stress to soil surrounding a construction site for a soil column. Methods according to the present disclosure may reduce impact on the environment because they may be performed with only one piece of normal construction equipment. In addition, gravel, crushed stone, cement or chemicals may not be required.

23 Claims, 7 Drawing Sheets

APPARATUS AND METHOD FOR PRODUCING SOIL COLUMNS

RELATED APPLICATIONS

This application claims priority under 35 U.S.C. §119(e) to U.S. Provisional Application No. 61/061,965 titled Apparatus and Method for Producing Soil Columns and filed on Jun. 16, 2008, which is fully incorporated by reference herein.

TECHNICAL FIELD

The field of the present disclosure relates to strengthening loose or weak soils in-situ for supporting structures and loads.

BACKGROUND

Soils at the ground surface and within several feet of the surface ("surface soils") are typically less consolidated than soils further from the surface ("deep soils"). Surface soils are generally more variable and possess lower strength than deep soils. In current civil engineering and building construction practice, the bottom of a building floor slab, building footings, or both, may be placed in surface soils. When the use of piles or piers is not economical the engineer/builder either excavates to the bottom of the objectionable surface soils and replaces them with better materials, or attempts to improve the objectionable surface soil in-situ by surface rolling with various kinds of conventional compaction equipment. With either of these approaches, subsequent testing is typically needed to confirm that the desired degree of soil improvement has been achieved, which results in additional project cost and time. The present inventor has recognized a need for a better method for improving surface soils to depths several feet below the ground surface. The present inventor has also recognized a need for less costly, faster, and quantifiable in-situ surface soil improvement apparatuses and methods to reduce construction time, increase construction efficiency, and allow results to be observed directly as the soil improvement progresses.

The present inventor has recognized that there are disadvantages with excavating and replacing objectionable surface soil and with current compaction equipment and techniques. Excavating and replacing loose surface soils beneath planned floor slabs or footings requires an adequate working area on the site for safely back sloping the excavation side walls, and for temporarily stockpiling the excavated surface soils while the excavation and replacement proceeds. Additionally, the proximity of nearby existing structures can necessitate expensive shoring and bracing of excavation sidewalls. A further disadvantage of the excavation-replacement option is that changing soil moisture content during the work (typically caused by either drying in hot weather or wetting in rainy weather) can reduce the feasibility of achieving the desired degree of compaction of the replacement material. Disadvantages of current compaction equipment and techniques used on existing surface soils is that changing soil moisture content during the work can reduce the feasibility of achieving the desired degree of compaction, and independent testing is commonly needed to determine whether the desired degree of compaction has been achieved. The methods and apparatus disclosed herein may help eliminate these problems by improving the surface soils in-place without removing and replacing the surface soils.

Additional aspects and advantages will be apparent from the following detailed description of preferred embodiments, which proceeds with reference to the accompanying drawings.

BRIEF DESCRIPTION OF THE DRAWINGS Brief Description of the Drawings

FIG. 1 illustrates an apparatus for creating a soil column in-situ in the ground, according to one embodiment.

FIG. 1*a* illustrates a top view of the surcharge ring illustrated in FIG. 1.

FIG. 1*b* illustrates a top view of an embodiment of a surcharge ring.

DETAILED DESCRIPTION OF PREFERRED EMBODIMENTS

For the sake of clarity and conciseness, certain aspects of components or steps of certain embodiments are presented without undue detail when such detail would be apparent to those skilled in the art in light of the teachings herein or when such detail would obfuscate an understanding of more pertinent aspects of the embodiments.

Figure 1:
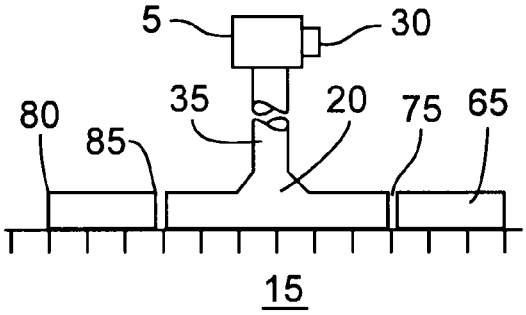
Figure 2:
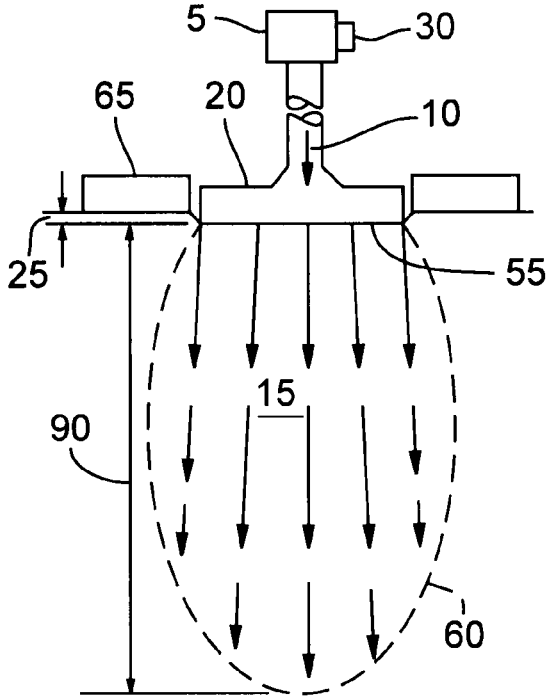
FIG. 2 illustrates the apparatus of FIG. 1 imparting a pressure to the soil.

FIGS. 1 and 2 illustrate an exemplary apparatus for constructing soil columns in-situ at ground level according to one embodiment. The apparatus includes an energy source 5 for delivering an impact force 10 to compact soil 15 beneath an impact foot 20. The energy source 5 may include, alone or in combination, pneumatic or hydraulic hammers, falling weights, or devices that generate a controlled explosion to drive impact foot 20, or other suitable devices. In certain embodiments, vibratory pile drivers or other suitable impact sources may be used as the energy source 5. As the soil 15 compacts, a deflection 25 of the surface of the soil 15 is preferably measured using a deflection monitoring device 30. For example, the deflection of the surface of the soil 15 may be measured directly, or the displacement of an impact foot 20 resting on the surface of the soil 15 may be measured to indicate the deflection of the surface of the soil 15.

The deflection monitoring device 30 may be attached in whole or part to the energy source 5. Alternatively, the deflection monitoring device may be attached in whole or part to the impact foot 20 or pedestal 35. Deflection monitoring device 30 may be any of a number of devices, for example, one suitable deflection-monitoring device 10 is described in U.S. Pat. No. 7,296,475 and sold as the Dynamic Deflection Instrument offered by Dynamic Force Solutions of West Linn, Oreg. However, other devices 10 may be provided to measure the deflection of the surface of the soil, such as the device described in GB 2,249,181, or other suitable devices.

The deflection monitoring device 30 preferably calculates or measures the displacement of the impact foot 20, for example as described in U.S. Pat. No. 7,296,475 or GB 2,249,181. The deflection monitoring device 30 is preferably configured to determine when a desired compaction is achieved. Some criteria for determining when a desired compaction is achieved are described below.

Figure 3:
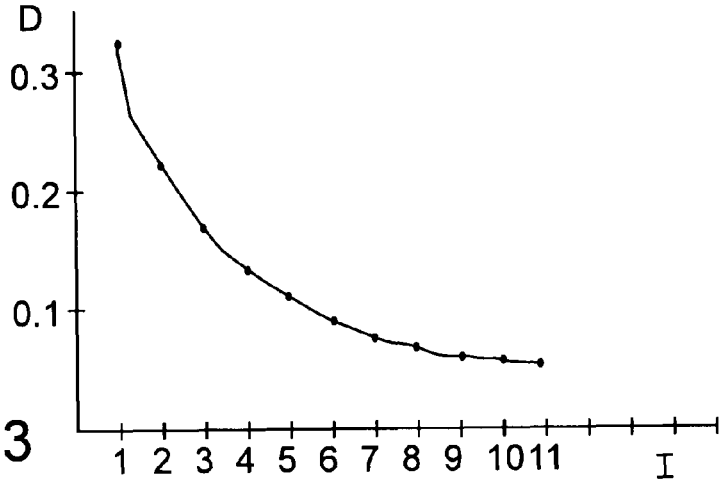
FIG. 3 illustrates a hypothetical deflection versus impact graph.

In some embodiments, the deflection monitoring device 30 provides a visual indication that a desired compaction is attained, for example, by lighting a light emitting diode. An operator may shut off the energy source 5 based on the visual indication provided by the deflection monitoring device. In other embodiments, the deflection monitoring device 30 is operably connected to the energy source 5, for example, by a wired connection or by a wireless connection such as Bluetooth® or an infrared transponder link. And, the deflection monitoring device 30 preferably transmits a signal to the energy source 5 telling the energy source 5 to deactivate when a determination is made that a desired compaction is achieved. For example, the deflection monitoring device 30 preferably includes a processor, hardwired programming, firmware, or software that analyzes the measured displacements of the impact foot 20 to determine when a desired compaction is achieved. For example, when deflection versus impact is plotted on a graph, the graph typically shows the deflection decaying either logarithmically or exponentially as hypothetically illustrated in FIG. 3. One point at which a desired compaction is achieved may be in the vicinity of where the graph becomes almost asymptotic. Referring to FIG. 3, a hypothetical displacement in inches, D, is plotted against the number of impacts, I. The displacement D for I8, I9, I10, and I11 may be considered as almost asymptotic. Depending on factors such as the structure to be supported by soil column 60, the amount of permissible settling, and other suitable factors, the deflection monitoring device 30 may determine when a desired compaction is achieved and tell the energy source 5 to deactivate, for example, after I8, I9, I10, or I11.

Figure 4:
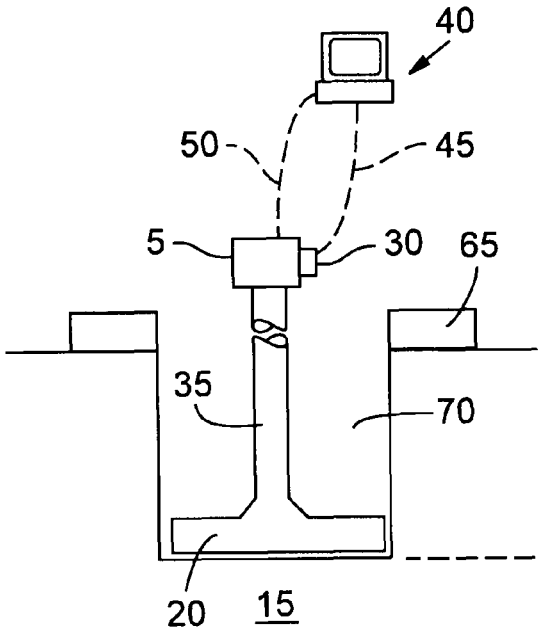
FIG. 4 illustrates an apparatus for creating a soil column in-situ in the ground at the bottom of a pre-excavated cavity, according to one embodiment.

Referring to FIG. 4, in alternate embodiments the deflection monitoring device 30 may be operably connected to a signal processor, such as computer 40, over a first wireless connection 45, for example, and the computer 40 may be operably connected to the energy source 5 over a second wireless connection 50, for example. The deflection monitoring device 30 may transmit a signal to the computer 40 indicating the magnitude of the displacement of the impact foot 20 after being impacted by the energy source 5. The computer 40 may process the signals from the deflection monitoring device 30 to determine when a desired compaction is achieved, and send a signal to the energy source 5 telling the energy source 5 to deactivate. In alternate embodiments, a human operator may view the compaction results on the computer 40 and cause the computer 40 to transmit a signal to the energy source 5 telling the energy source 5 to deactivate, or the operator may deactivate the energy source 5 directly. In other embodiments, instead of a computer 40, the deflection monitoring device 30 may be operably connected to a different suitable signal processing device such as a television, display screen, or printer that displays signals, or other suitable information, from the deflection monitoring device 30 for an operator to view.

Referring again to FIGS. 1 and 2, pedestal 35 preferably extends from the energy source 5 to a base of the impact foot 20. The energy source 5 is preferably mechanically coupled to the impact foot 20 by directly or indirectly contacting the impact foot 20, for example, or by being rigidly attached to the impact foot 20, for example, by pedestal 35. The impact foot 20 is constructed from a material having sufficient rigidity and thickness to distribute the impact force 10 across the soil engaging foot surface 55 of the impact foot 20 without substantially deforming the impact foot 20. For example, the impact foot 20 may be constructed from a rigid material such as a metal like steel, aluminum, and alloys thereof. In one embodiment, the impact foot 20 may include a steel circular base having a diameter of approximately 29 inches and a thickness of approximately 6½ inches. However, other dimensions and materials may be used. In addition, the base of the impact foot 20 may take other shapes, such as a square or other polygon, or may have a soil engaging foot surface 55 that is not flat, for example, a circular base with beveled edges as illustrated in FIG. 2 of U.S. Pat. No. 5,249,892, conical, or other suitable shape.

A surcharge load, or pressure, is preferably applied to soil 15 adjacent the soil column 60 to restrain or confine the soil in the soil column 60, the soil 15 adjacent the soil column 60, or both. The amount of restraint or confinement may depend on several factors, including the plan dimensions of the impact foot 20 used to deliver the first pressure to the soil 15 or the magnitude of the impact force 10 applied by the energy source 5. In one embodiment, a circumferential surcharge ring 65 surrounds the impact foot 20 to help inhibit soil 15 adjacent to the soil column 60, soil in the soil column 60, or both, from substantially loosening while constructing the soil column 60. For example, without the surcharge ring 65, the soil 15 adjacent the soil column 60 may loosen because of failing in shear, rising vertically upward at the ground surface, or other soil loosening mechanism. In alternate embodiments, such as illustrated in FIG. 1*b*, a plurality of items 66, such as two or more pieces of a surcharge ring, such as surcharge ring 65, concrete blocks, stones, or other suitably massive items 66, are arranged on the ground to form a surcharge ring 65*b*. Surcharge ring 65*b* preferably surrounds where the soil column 60 is to be built and applies a surcharge load, or pressure, to soil 15 surrounding the soil column 60. The items 66 preferably touch one another, or are separated by less than one inch, when placed on the ground surrounding where the soil column 60 will be built, however, other separation distances may be used.

Figure 5:
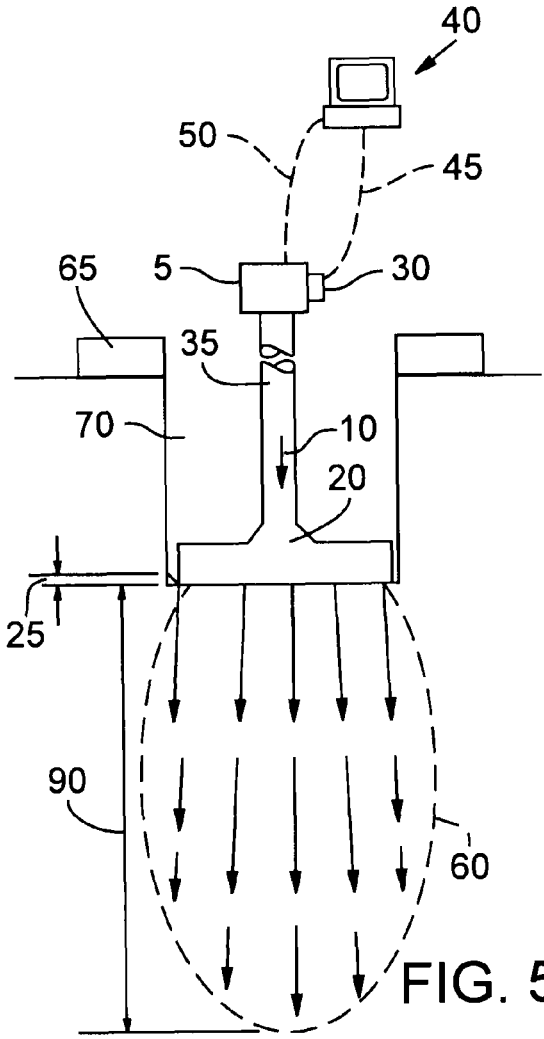
FIG. 5 illustrates the apparatus of FIG. 4 imparting a pressure to the soil at the bottom of the pre-excavated cavity.

As shown in FIGS. 4 and 5, an exemplary apparatus is utilized to construct soil columns in the ground at the bottom of a pre-excavated cavity 70. In such embodiments the soil column 60 may be constructed at the bottom of a pre-excavated cavity 70 and the weight of the soil 15 adjacent the excavated cavity 70 may provide a portion of the soil stress, while a portion of the soil stress may also be provided by the surcharge ring 65.

Surcharge rings, such as surcharge ring 65, may take many forms depending on factors such as the soil conditions and the soil column 60 to be built. And, the surcharge ring 65 may be adjusted as needed. In one embodiment, the surcharge ring 65 may be isolated from direct contact with the energy source 5 and the impact foot 20. In another embodiment the surcharge ring 65 may rest at ground level directly on the soil 15 adjacent to the soil column 60. In other embodiments the soil column 60 may be constructed at some depth below the ground surface, such as below the level of planned future footing excavation, and the surcharge ring 65 may rest at ground level with a layer of soil 15 between the surcharge ring 65 and the soil 15 adjacent the soil column 60.

The surcharge ring 65 may be constructed from a metal, such as steel, aluminum, and alloys, or the surcharge ring 65 may be constructed from other materials, such as plastic. The surcharge ring 65 may be a rigid structure, but does not need to be. For example, the surcharge ring 65 may be a bladder that is filled with liquid to exert pressure on the soil 15. The inside plan dimensions of the surcharge ring 65 may be slightly larger than the outside dimensions of the impact foot 20 so that the surcharge ring 65 tightly surrounds the impact foot 20. The term "tightly" means a gap of approximately one inch or less is provided between the impact foot 20 and the surcharge ring 65. According to one embodiment, the surcharge ring 65 is made from steel, has a diameter of approximately 50 inches, and a thickness of approximately 4-6 inches. However, other dimensions may be used. While the surcharge ring 65 generally conforms to the shape of the impact foot 20, this need not be the case.

Figure 1A:
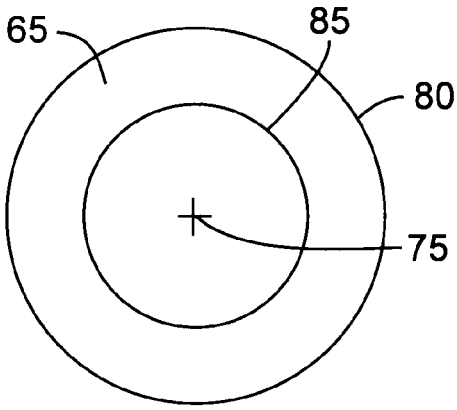
Figure 1B:
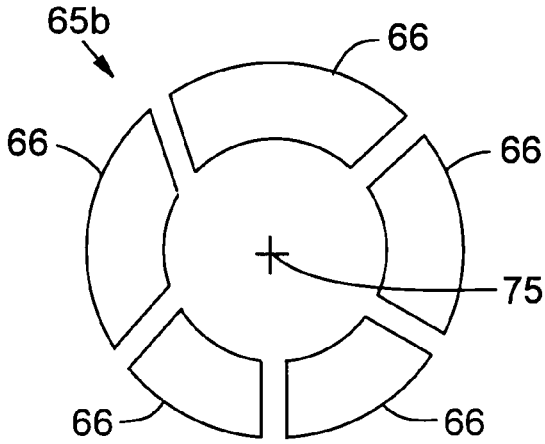

FIGS. 1 and 1*a* illustrate an embodiment of a surcharge ring 65 for use with a circular impact foot 20. The discussion pertaining to FIG. 1 describes geometric relationships based on a circular geometry, however, the impact foot 20 and the surcharge ring 65 may have different geometric shapes. The geometric relationships discussed therefore describe one embodiment, and serve as guidelines for constructing other embodiments.

In the illustrated embodiment, the distance from the center of the central aperture 75 to the outside portion 80 of the surcharge ring 65 is preferably between 1.5 and 2 times the distance from the center of the central aperture 75 to the inner portion 85 of the surcharge ring 65. Larger or smaller distances may be used. In a particular embodiment, the distance from the center of the central aperture 75 to the outside portion 80 of the surcharge ring 65 is 1.67 times the distance from the center of the central aperture 75 to the inner portion 85 of the surcharge ring 65.

Preferably, a space exists between the inner portion 85 of the surcharge ring 65 and the impact foot 20. The space between the impact foot 20 and the surcharge ring 65 is relatively small, or tight, preferably an inch or less, but may vary depending on soil type, soil condition, or other factors. Having a space between the surcharge ring 65 and the impact foot 20 may prevent impact energy from the energy source 5 from being transferred to the surcharge ring 65 and potentially loosening the soil 15 near the impact foot 20 because of vibration, resonance, or other mechanisms.

The surcharge ring 65 may be solid, hollow, or partially hollow, as described below, and is made from a material suitable for applying pressure to the soil 15. The surcharge ring 65 is preferably designed to place pressure on the soil 15 via a soil engaging ring surface 67 to reduce the likelihood that the soil 15 surrounding the soil column 60 may loosen while the soil column 60 is being built. For example, the surcharge ring 65 is preferably designed to apply a pressure equal to 10%, or more, of the pressure exerted by the soil engaging foot surface 55 of the impact foot 20. The amount of pressure exerted on the soil 15 by the surcharge ring 65 may be varied depending on the soil 15, the shape, depth, or both, of the soil column 60 to be built, or other factors.

Figure 6:
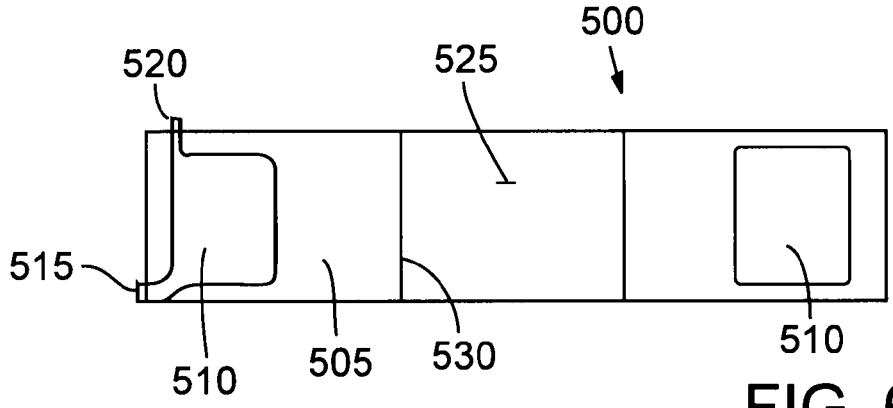
FIG. 6 illustrates a cross section view of another embodiment of a surcharge ring.
Figure 7:
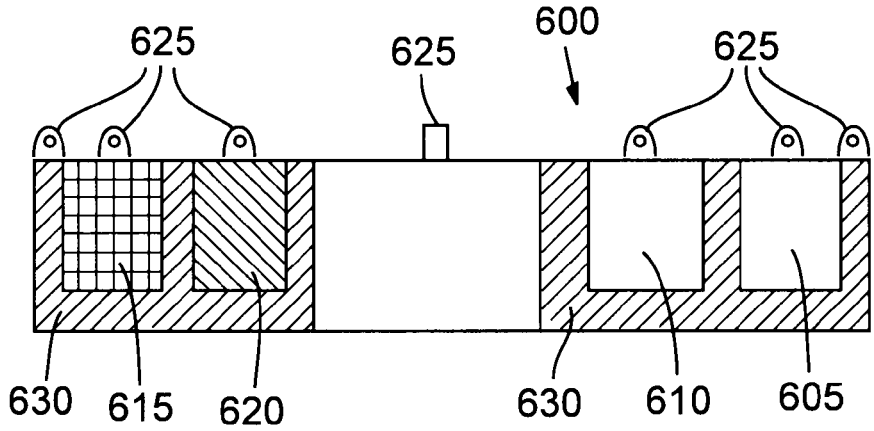
FIG. 7 illustrates a cross section view of another embodiment of a surcharge ring.

As illustrated in FIGS. 6 and 7, one or more hollow cavities, such as hollow cavities 510, in the surcharge ring, such as surcharge ring 500, may be filled with liquid to increase the mass of the surcharge ring, or drained to decrease the mass of the surcharge ring. Hollow cavities may also have fill openings, drain openings, or both, such as drain 515 and fill opening 520, to permit liquid levels in the hollow cavities to be varied. Additionally, hollow cavities may have different geometric variations, or different density materials, including liquids and solids, may be located in or on the surcharge ring to permit varying the pressure applied to the soil 15 in a direction radial from the center of the surcharge ring. For example, a hollow cavity may be provided within a surcharge ring to provide additional weight when the cavity is filled with material. In addition, a tank (not illustrated) may be mounted to the surcharge ring or additional weights may be placed on the surcharge ring if needed.

FIG. 6 illustrates a surcharge ring 500 having a solid portion 505 and a cavity 510. The cavity 510 has a drain 515 and a fill opening 520. The drain 515 and the fill opening 520 may be closed or sealed in any conventional manner. The construction of the surcharge ring 500 illustrated in FIG. 6 preferably applies a greater pressure on the soil 15 near the impact foot 20 than the soil 15 located at the outer circumferential edge of the surcharge ring 500. For example, the surcharge ring 500 may be designed for the solid portion 505 to apply a pressure equal to 10% of the pressure exerted by the soil engaging foot surface 55 of the impact foot 20 (FIG. 2). In other embodiments, greater pressure may be exerted by the solid portion 505 of the surcharge ring 500. The pressure of 10% of the pressure exerted by the soil engaging foot surface 55 of the impact foot 20 may be applied by the surcharge ring 500 for a radial distance that is approximately a third of the distance from the center of aperture 525 to the inner portion 530 of the surcharge ring 500. The pressure exerted on the soil 15 by the remaining outer portion of the surcharge ring 500 may be 50% less than the pressure exerted by the inner, solid portion 505 of the surcharge ring 500. Other weight distributions may be used. Adding or removing liquid from the cavity 510 may primarily affect the pressure exerted by the outer portion of the surcharge ring 500. In some embodiments, the surcharge ring 500 may exert a substantially constant pressure on the soil 15 over the entire radial distance when the cavity 510 is filled with water, for example.

FIG. 7 illustrates another embodiment of a surcharge ring 600. The surcharge ring 600 may be constructed to contain two channels 605 and 610. Fewer or more channels, or different shape openings may be also be used. The surcharge ring 600 may be made by casting steel or iron, for example, to include inner channel 610 and outer channel 605. The channels 605 and 610 may be formed to receive first and second annular rings 615 and 620, respectively. Annular rings 615 and 620 may be made from the same material as the surcharge ring 600, or each other, or may be made from different materials. For example, second annular ring 620 may be made from steel and first annular ring 615 may be made from aluminum. Selectively including first or second annular rings 615 and 620, or both, changes the pressure the surcharge ring 600 exerts on the soil 15 in a radial direction. For example, including second annular ring 620, but not first annular ring 615 increases the pressure exerted on the soil 15 by the central portions of the surcharge ring 600 compared to the circumferential portions of the surcharge ring 600. Materials other than the annular rings 615 and 620 may be placed in the channels 605 and 610, for example, the channels 605 or 610 may be filled or partially filled with gravel, water, or other suitable material.

Attachment points 625 may be secured to the surcharge ring 600, for example, by integrally forming, welding, bolts, or other suitable securing means. Attachment points 625 may be connected to a crane by cables or otherwise, and may permit the surcharge ring 600 to be picked up and moved.

Attachment points 625 may also be secured to the annular rings 615 and 620 and used to pick up and move the annular rings 615 and 620 independent of the surcharge ring 600.

The downward pressure exerted on the soil 15 by a surcharge ring, such as surcharge ring 20, may result from one or a combination of dead weight, mechanical force applied to the surcharge ring, hydraulic or pneumatic force applied to the surcharge ring, or any other similar means. The downward pressure exerted on the soil 15 by the surcharge ring may be adjusted to lessen the ability of the soil 15 below the surcharge ring to rise vertically or otherwise move while a soil column, such as soil column 60, is being constructed.

The impact force 10 applied by the energy source, such as energy source 5, may be determined by direct measurement, engineering calculation, or by reference to specific equipment specifications. Direct measurement is preferred because engineering calculations and equipment specifications may be inaccurate due to equipment wear, environmental operating conditions, and other factors affecting the performance of the energy source applying the dynamic force, for example, high frictional forces that reduce the amount of energy delivered for an impact.

Figure 8:
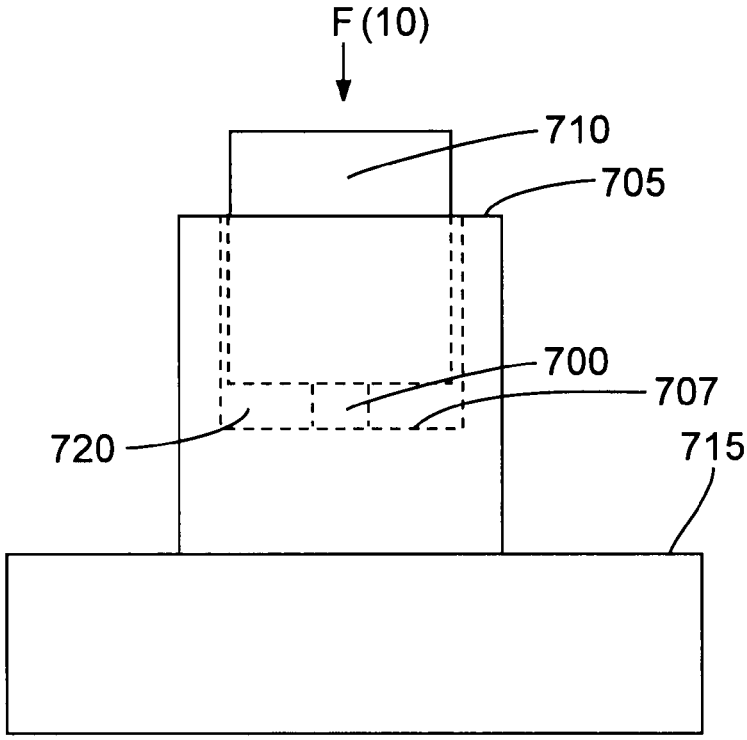
FIG. 8 illustrates a portable field testing device for determining the magnitude of the impact force delivered by the energy source, according to one embodiment.

Referring to FIG. 8, a schematic diagram for a preferred apparatus for directly measuring the impact force 10 is illustrated. Measurements are preferably conveniently and efficiently accomplished in the field by applying the dynamic impact force to a precisely machined puck of aluminum alloy 700 that possesses a known, well defined stress versus strain relationship. The magnitude of the applied force is preferably determined from a measured change in the puck's dimensions, and can be readily checked as often as needed in the field to assure consistent impact force delivery by the energy source.

In the preferred method, the magnitude of the impact force 10 is determined by placing a precisely machined puck of alloy material 700 with consistent material properties into a cradle 705 that allows the impact force 10 to be delivered axially through a piston 710 into the puck 700. Preferably, the cradle 705 includes an anvil surface 707 that is substantially flat, that is, flat within plus or minus 0.01 inch, for at least the diameter of the puck 700. The preferred shape of the puck 700 is a solid cylinder with a ½ inch diameter plus or minus 0.001 of an inch and a ½ inch length plus or minus 0.001 of an inch. The preferred alloy material is T-6061 aluminum. Cradle 705 preferably rests on, or is attached to, a base 715 to help ensure cradle 705 is not substantially displaced by the impact force 10. Changes in the dimensions of the impacted puck 700 are measured and compared against measured changes to pucks 700 of nearly identical construction where the changes were induced by static forces of known magnitudes as described below.

Several of the pucks 700, for example, 6 to 10, are compressed under laboratory conditions with a known compression force. The first puck 700 is placed in the cradle 705 and a piston 710 is placed on the puck 700. A compression force of a known amount is applied to the piston 710 causing the puck 700 to deform. For example, the compression force may be applied using a hydraulic press manufactured by Enerpac of Milwaukee, Wis. The change in diameter at the middle of the puck 700, that is, midway between both flat surfaces, is measured, using calipers or other highly accurate instruments,. The change in length of the puck 700 is also measured. Each of the 6 to 10 pucks 700 is compressed in a similar manner, but with a different, known compression force. For example, compression forces of 500 pounds, 1,000 pounds, 3,000 pounds, 5,000 pounds, 7,000 pounds, and at increasing 2,000 pound increments to 25,000 pounds may be used to create a graph. One or more graphs may be made of compression force versus diameter and length changes for the 6 to 10 pucks 700.

In the field, the impact foot 20 is positioned on the piston 710 which is placed on the puck 700 in the test cradle 705. The cradle 705 is preferably supported on a base 715 that deflects no more than 0.01 inch when the puck 700 is struck with one blow to the impact foot 20. An exemplary cradle 705 is a steel block with dimensions of 4 inches×4 inches×4 inches and having a 3 inch diameter hole 720 with a depth of 3.5 inches. The piston 710 is preferably a 2.875 inch diameter steel rod with a height of 3 inches. The base 715 is preferably a steel plate that is 12 inches×12 inches×4 inches. The material used for the cradle 705, piston 710, and base 715 is preferably harder than the material used for the puck 700, and preferably does not significantly deform when the puck 700 is impacted or compressed.

The energy source 5 is then activated to impact the piston 710 and impart the impact force 10 to the puck 700. Calipers, or other suitable instruments, are used to measure the height change and the lateral bulging, that is, the diameter change at the middle of the puck 700 resulting from the impact force 10. The height change and diameter change are compared to the graph of the known height changes and known diameter changes versus known compression forces for the puck 700. The magnitude of the impact force 10 delivered to the puck 700 in the field can be interpolated from the pre-established laboratory calibration curve of compression force versus vertical and lateral deflections for the puck 700. By such an interpolation, the impact force 10 is correlated to a compression force thus providing an indication of the magnitude of the impact force 10 in terms of compression force. To determine a correlated compression force, the height change is first compared to a graph of height change vs. compression force. Then, the diameter change is compared to a graph of diameter change vs. compression force as a verification.

Based on the correlated static magnitude of the impact force 10 applied by the energy source 5, a ratio of stress versus strain (also referred to as a modulus) for the given equipment and soil 15 may be calculated. The correlated static magnitude of the dynamic impact force 10 in force units and the deflection resulting from each impact as recorded by the deflection monitoring device 30 are preferably input into formulas for determining the soil modulus. For example, for a deflection 25 resulting from the impact force 10, the resultant soil modulus may be defined as the correlated static magnitude of the force 10 divided by the product of the area of the soil engaging foot surface 55 of the impact foot 20 and the deflection 25. By using the correlated static magnitude of the impact force 10 and the deflection 25 accompanying the application of the impact force 10, a value for the initial unimproved soil modulus may be calculated from an initial impact. Likewise, a change in the soil modulus may be determined for each subsequent impact.

Based on construction design criteria, a desired compaction, such as a point at which additional modulus changes are not needed, is preferably determined. For example, additional soil modulus changes may not be needed if the deflection 25 is between 0.05 to 0.10 of an inch and the amount of deflection has diminished over the previous five applications of the dynamic impact force 10. Alternatively, a desired compaction may be attained where a graph of deflection changes becomes asymptotic or almost asymptotic. In other embodiments, a desired compaction may be attained where the slope of a tangent to a plot of deflection versus number of impacts falls below a predetermined level, for example, less than 5 degrees.

In other embodiments, determining when a desired compaction is attained accounts for the correlated static magnitude of the dynamic impact force 10 in conjunction with one or more of the amount of deflection 25 for the last application of the dynamic impact force 10, deflection change becoming asymptotic or almost asymptotic, or a slope of a tangent to a plot of deflection versus number of impacts falling below a predetermined level.

By monitoring the deflection 25 accompanying each application of the dynamic impact force 10, and, preferably by also knowing the correlated static magnitude of the dynamic impact force 10, a modulus value for the unimproved soil 15 surrounding the soil column 60 may be calculated as well as a modulus value for the completed soil column 60 itself. The modulus values may then provide a basis for geotechnical engineering calculations to predict future settlement of structures supported on both the unimproved surface soil 15 and the soil columns 60. Thus, geotechnical engineering calculations may be used to determine when a desired compaction is attained.

In addition, the numerical values that define the relationships between the applied stress and the deflections (i.e., modulus) of the soil before and after construction of the soil column allow several performance calculations to be made. In one embodiment the relationships allow the relative increase in strength and reduction in compressibility of the surface soil at the completed soil column locations to be calculated so that the performance of floor slabs and footings constructed over the soil column may be predicted. For example, a structural footing underlain directly by one or more soil columns will impart a bearing stress at the top of a soil column that is greater than the bearing stress applied by the footing to the untreated soil. The greater bearing stress at the top of the soil column is believed to be caused by the rigidity of the footing and the fact that the soil columns are stiffer than the untreated soil between soil columns. Therefore, settling experienced by the footing due to compression of the supporting soil within the depth of the soil column reinforcement will be approximately equal to the settlement of the soil column itself. The settlement of the soil column may be calculated as the bearing stress applied by the footing to the top of the soil column divided by the modulus of the soil column. Therefore, performance calculations may also be used to determine when a desired compaction is attained.

Geotechnical engineering calculations may also help select the appropriate horizontal spacing between the soil columns to achieve the desired performance of the structure supported on the soil columns. For example, the ratio obtained by dividing the modulus of the soil column by the modulus of the soil without the soil column is defined as a Relative Stiffness Ratio. The ratio of the combined cross sectional area of the untreated soil on which the footing rests to the combined cross sectional area of the soil columns contacting the footing bottom is defined as the Area Ratio. Knowing the allowable settlement for the footing, the Relative Stiffness Ratio, and the modulus of the soil column, one can calculate the Area Ratio that corresponds to the allowable footing settlement. From the calculated Area Ratio, the required spacing of the soil columns can be calculated.

Figure 10:
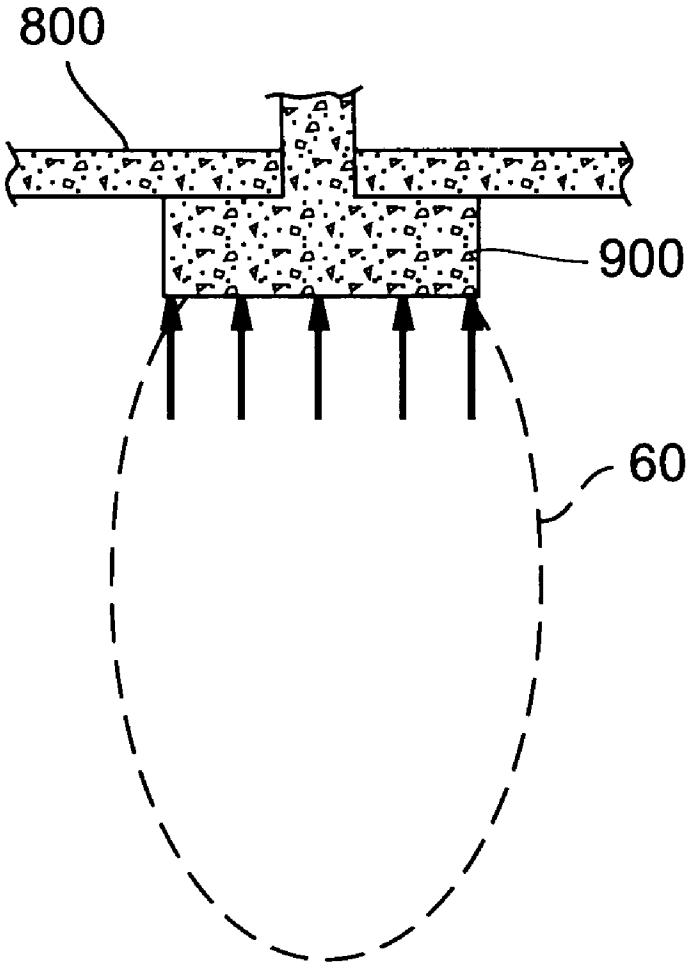
FIG. 10 illustrates a footing and floor slab supported on a soil column, according to another embodiment.
Figure 9:
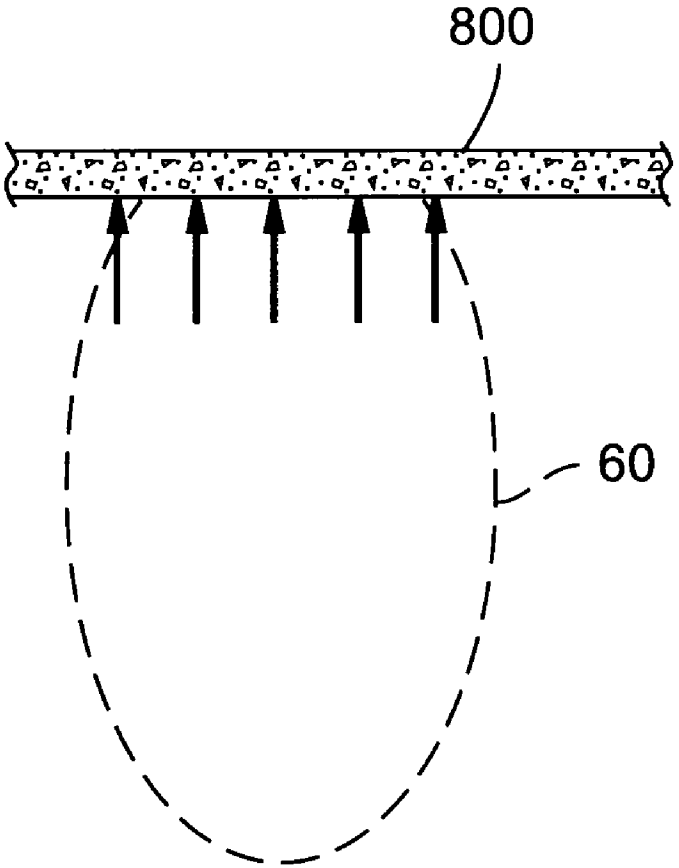
FIG. 9 illustrates a building floor slab supported on a soil column, according to one embodiment.

Referring to FIGS. 9 and 10, after one or more soil columns 60 have been constructed, a building floor slab 800 may be supported on the soil column 60. In other embodiments, the soil column 60 may support a footing 900 and floor slab 800.

The effective depth 90 of the soil column 60 (FIG. 2) depends on several factors, including the soil type, the magnitude of the dynamic impact force 10, and the plan dimensions of the soil engaging foot surface 55 of the impact foot 20 that delivers to the soil 15 pressure resulting from the impact force 10. The as-built depth 90 of the soil column 60 may be evaluated using various methods employing geotechnical testing and instrumentation. Although such evaluation is not necessary, it may be performed to verify the results of the modulus calculations. One such evaluation method involves pushing a calibrated small diameter machined steel cone into the soil 15 both before and after the soil column 60 is constructed and measuring the penetration resistance at various depths. The depth at which the before and after penetration resistance values converge defines the overall length of the soil column produced, and if desired may be used as a means for assigning modulus values at various depths in the column.

Figure 11:
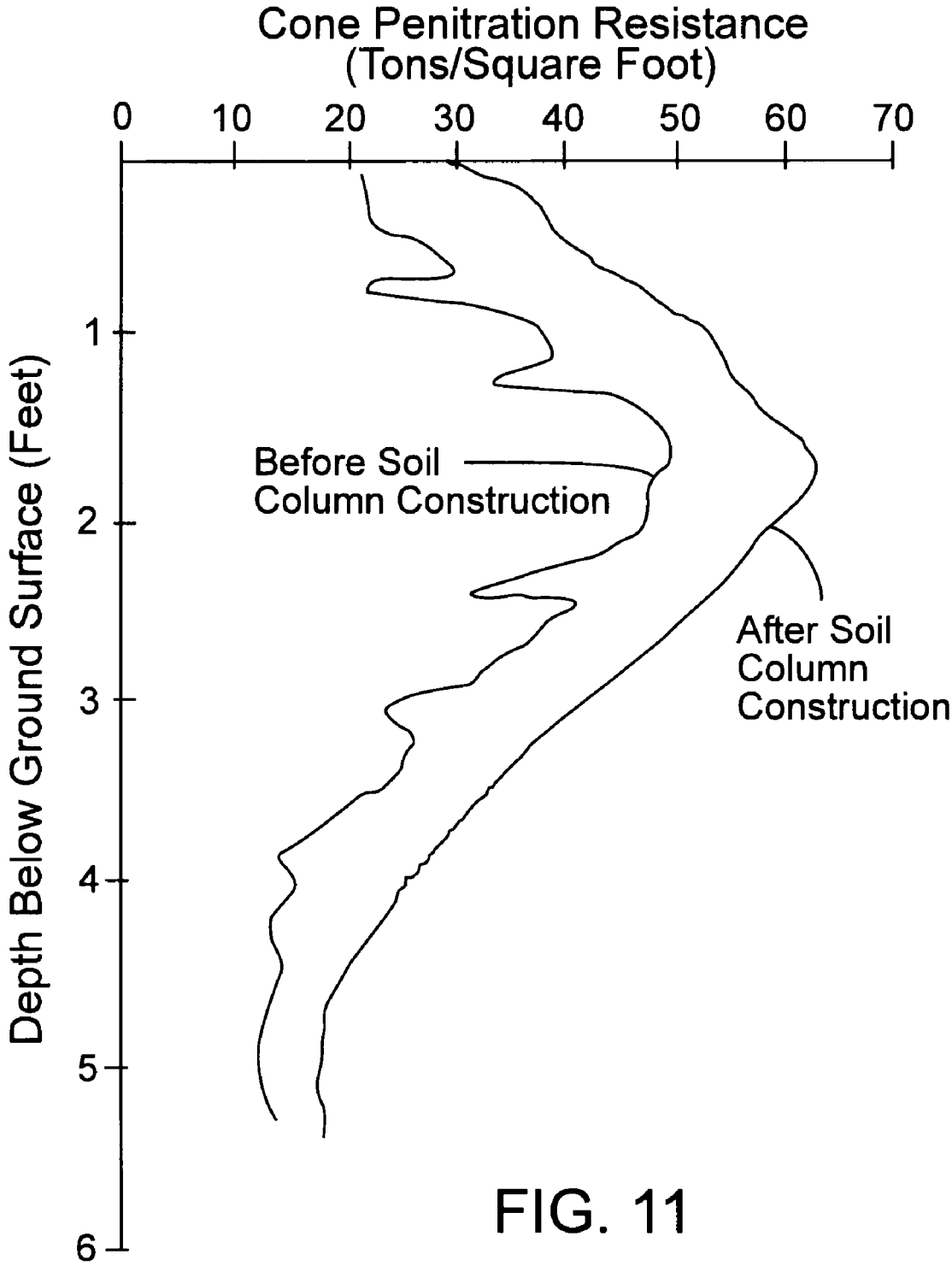
FIG. 11 is a graph illustrating predicted cone penetration resistance test results that might be obtained from pushing a machined small diameter calibrated cone into soil before and after a soil column has been constructed.

Referring to FIG. 11, a hypothetical evaluation using field testing results before and after soil column construction is illustrated. The vertical axis illustrates the depth below the surface of the ground (in feet) and the horizontal axis illustrates a cone penetration resistance (in tons per square foot). The test results may be obtained using a machined small diameter cone pushed with a steady force into the soil and used to record penetration resistances at various depths. The cone typically represents a solid made by revolving a right triangle having angles of 30 degrees, 60 degrees, and 90 degrees. The 30 degree angle is at the tip of the cone, and the cone has a surface area of 1.25 square centimeters. The penetration resistance of the cone may be recorded and plotted versus depth below the ground surface. FIG. 11 shows expected pre-soil column construction data and post-soil column construction data for a typical soil consisting of sand or silty sand. For the pre-construction data, the depth below ground surface refers to the original grade of the soil before constructing the column. For the post-construction data, the depth below ground surface refers to the bottom of the indentation made by the impact foot 20 after constructing the column. The post-construction testing may be done after soil pore pressures caused by the impact force have dissipated, typically after 72 hours. The testing may be performed to verify the calculated values for the soil stress versus strain characteristics, both before and after constructing a soil column, and may verify the depth of a soil column by indicating where the pre-construction and post-construction curves intersect.

Figure 12:
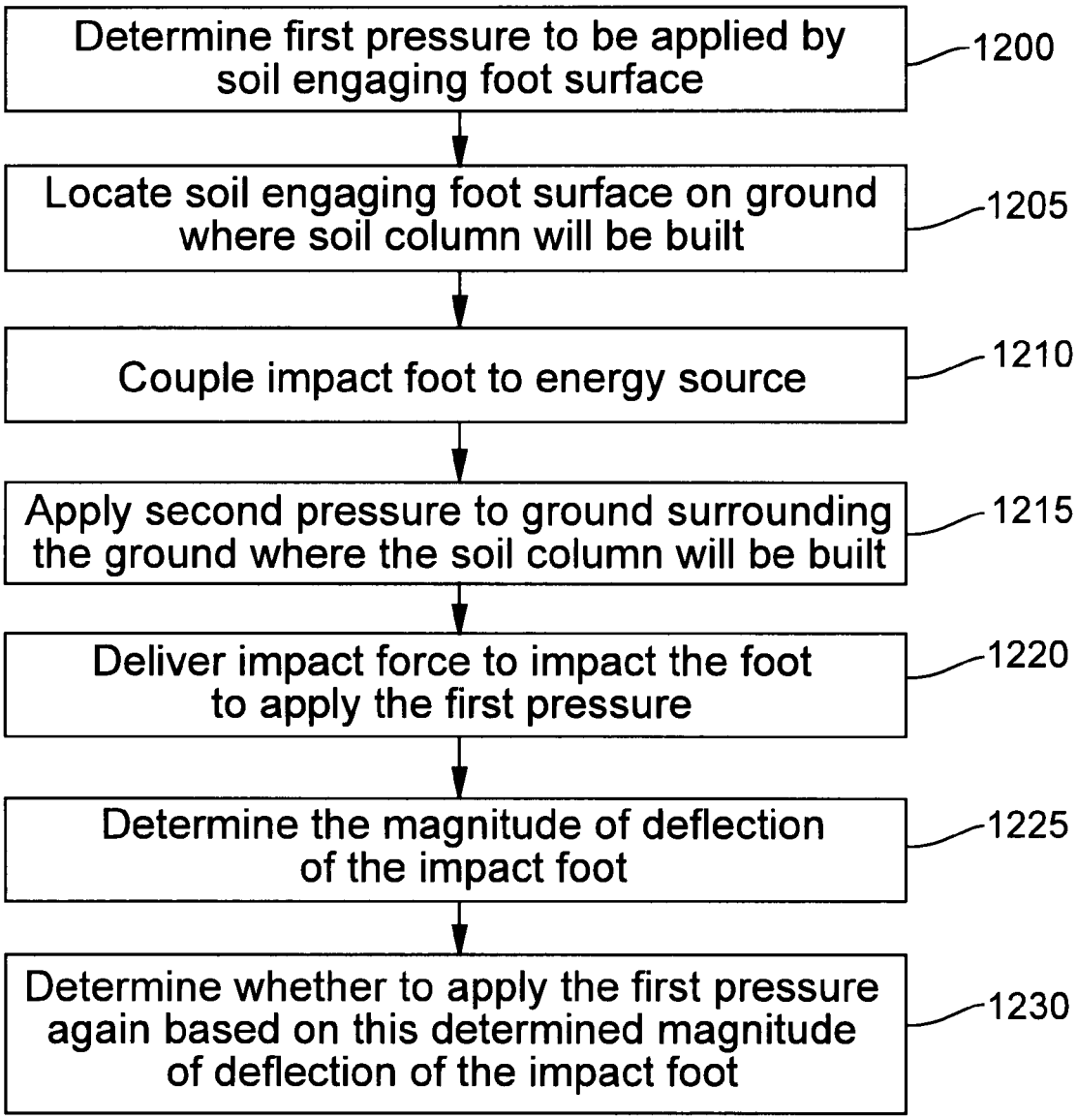
FIG. 12 illustrates a flowchart for a method of building a soil column.

Referring to FIGS. 1, 2, and 12, one or more soil columns 60 may be constructed in-situ in the ground according to the following method. The correlated static magnitude of the impact force 10 may be determined prior to impacting, for example, by striking a precisely machined puck 700 as described above. At step 1200, the first pressure to be applied by the soil engaging foot surface 55 is determined based on the magnitude of the impact force 10 and the area of the soil engaging foot surface 55. At step 1205, the soil engaging foot surface 55 is placed on the ground where a soil column 60 is to be built. The impact foot 20 is mechanically coupled to the energy source 5 at step 1210. The order of steps 1205 and 1210 is not important, for example, steps 1205 and 1210 may be reversed. Surcharge ring 65 is then placed adjacent the impact foot 20 at step 1215 so that a second pressure resulting from placing the soil engaging ring surface 67 on the ground is applied to the soil 15 surrounding the location where the soil column 60 is to be built. The second pressure applied by the soil engaging ring surface 67 is preferably at least 10 percent of the first pressure to be applied by the soil engaging foot surface 55.

With the impact foot 20 and the surcharge ring 65 resting on the ground, the energy source 5 delivers an impact force 10 to the impact foot 20 at step 1220. The impact force 10 is preferably distributed across the soil engaging foot surface 55 of the impact foot 20, which in turn distributes the impact force as the first pressure into the soil 15 below the foot 20. The impact force 10 compacts the soil resulting in a deflection 25 at the base of the impact foot 20. Optionally, the magnitude of the deflection 25 is determined by the deflection monitoring device 30 at step 1225, for example, by measuring the difference in the location of the impact foot 20 before and after applying the impact force 10. The deflection monitoring device 30 is preferably attached either in whole or in part to either the energy source 5 or the impact foot 20. At step 1230 an optional determination of whether to apply the first pressure again is made based on the deflection determined at step 1225, for example, by the deflection monitoring device 30, a computer communicating with the deflection monitoring device 30, or by an operator viewing results on a display communicating with the deflection monitoring device 30, as described above.

The relationship between the first pressure (in force units per unit of area of the soil engaging foot surface 55) and the resulting initial deflection defines a stress versus strain characteristic (i.e. a modulus) for the soil 15 in its initial, in-situ, unstressed condition. The impact force 10 is then applied repeatedly to the impact foot 20 until the deflection 25 resulting from each impact is very small and relatively constant, at which time construction of the soil column 60 is complete and its stress versus strain characteristic (i.e. its modulus) is defined by the deflection 25 recorded for the final impact. Depending on soil types, an effective operational range for the impact force 10 is preferably in the range of 10,000 pounds-force to 20,000 pounds-force, when correlated to static force. However, impact forces 10 outside such a range may be used depending on the soil type, soil moisture content, structure to be built, and other suitable factors.

For example, the magnitude of the deflection 25 may have decreased over the previous five impacts and the deflection for the final impact may be 0.10 of an inch, indicating that the expected deflection 25 for further impacts may be very small and relatively constant. What is considered to be very small and relatively constant may be influenced by soil type and the type of structure to be built on the soil, therefore values for very small and relatively constant deflections may range from, for example, 0.05 inch for relatively dry predominantly granular soils to 0.1 inch for moist silty granular soils. Likewise different structure types have ranges of deflections (settlement after the structure is built), and may range from 0.05 inch for structures that are relatively settlement sensitive, such as masonry structures, to 0.1 inch for less settlement sensitive structures such as light metal buildings. Comparison of the initial and final stress versus strain relationships indicates how the completed soil column 60 and the adjacent non-pre-stressed soil 15 may react to surface loading. The effective depth of influence 90 of the completed soil column 60 may be determined by testing or probing the soil before and after the soil column construction if desired.

In other embodiments, a soil column 60 may be constructed in-situ in the ground after pre-excavating the soil, and also in a manner that results in a soil column 60 with verifiable, changed stress versus strain characteristics relative compared to the original unstressed soil. Optionally, a soil test or probe may be conducted at the site where a soil column 60 is to be built to determine pre-soil column soil characteristics. The magnitude of the force 10 applied by the dynamic impact of an energy source 5 may also be determined prior to, or during, constructing the soil column 60. Stress versus strain characteristics of the soil in its original unimproved state may be determined based on the magnitude of the force 10 applied by the dynamic impact of an energy source 5 and the displacement of an impact foot 20. Changes to the stress versus strain characteristics for the soil 15 achieved with each application of the dynamic impact force 10 to the soil 15 may be determined. Determining when a desired compaction is attained may be made by determining when additional applications of the impact force 10 may produce significantly diminishing changes to the stress versus strain characteristics. Ceasing additional applications of the impact force 10 may be based on the stress versus strain characteristics for the soil 15 in its original state compared to the stress versus strain characteristics for the soil 15 as of the last application of the dynamic impact force 10. For example, a 50-75% increase in stress versus strain characteristics of the soil column 60 over the stress versus strain characteristics of the untreated soil 15 may indicate that additional compaction may be of little additional benefit for settlement control of future structures or foundations placed over the treated soil 15. The ratio of the untreated soil modulus (which is indicative of the modulus of the untreated soil 15 between soil columns) to the final modulus of the soil column 60 itself represents the relative stiffness increase achieved at the treatment locations. The stiffness ratio may be used in engineering calculations as discussed above. Or, ceasing additional applications of the impact force 10 may be based on the amount of displacement of an impact foot 20 for the last application of the impact force 10 compared to a series of previous deflection amounts 25 for previous applications of the impact force 10.

Additionally, the future deflection both at the soil column location and in the surrounding unstressed soil due to later structural loading may be predicted by geotechnical engineering analysis as discussed above, and may be used to determine when a desired compaction is attained.

After one soil column 60 is completed, the energy source 5, impact foot 20, and surcharge ring 20 are preferably moved to a new location so that the method may be repeated to create another soil column 60. In certain embodiments, the changes to the stress versus strain achieved when a soil column 60 is built may be used to determine the location for additional soil columns 60 to be built. For example, pre- and post-stress versus strain characteristics at a location may indicate that a change has occurred in the subsurface soil type or consistency as compared to previous treatment locations. Additional engineering calculations, for example, those discussed above, may be undertaken to determine whether or not the spacing of treatment locations should be modified from the original plan.

Figure 13:
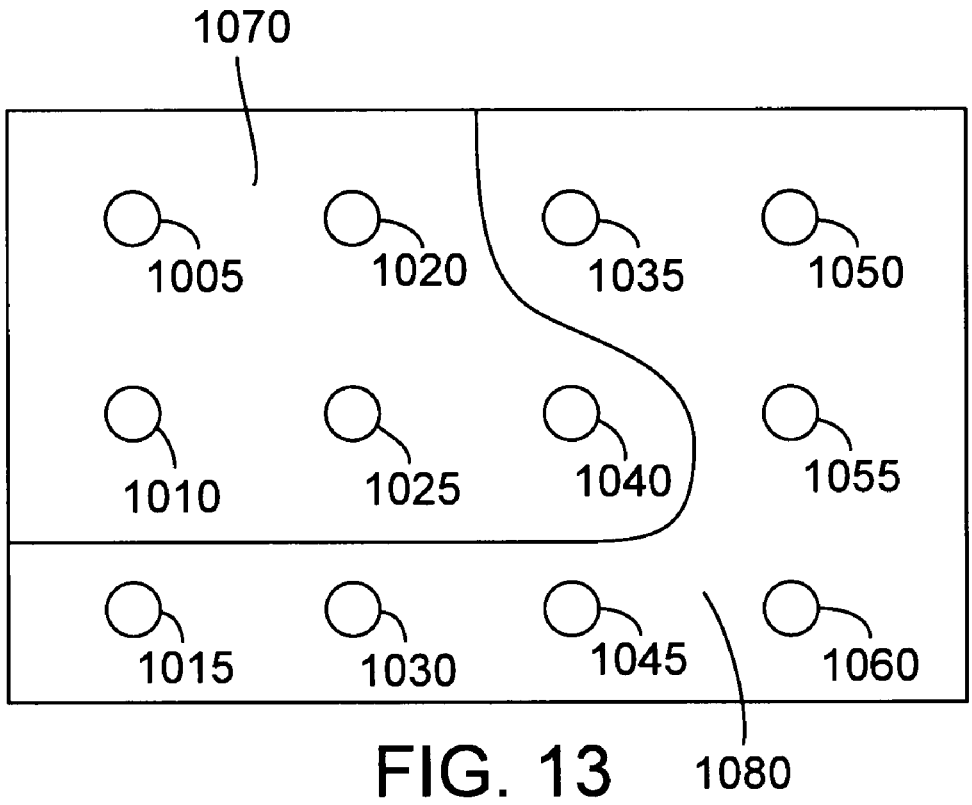
FIG. 13 illustrates a map of soil types made according to one embodiment.

In other embodiments, the calculated stress versus strain characteristics for un-compacted soil as well as the stress versus strain characteristics for compacted soil may be used to provide a map of the extent of relatively loose soils or subsurface obstructions. Referring to FIG. 13, for example, when each soil column 1005-1060 is built, a calculation may be made to determine the stress versus strain characteristics for the soil prior to compaction as described above. Comparing the initial stress versus strain characteristics to the locations of the soil columns 1005-1060 a map may be made that shows initial stress versus strain characteristics for various locations. For example, soil columns 1005, 1010, 1020, 1025, and 1040 may have initial stress versus strain characteristics indicating relatively weak surface soil 1070. The remaining soil columns 1015, 1030, 1035, 1045, and 1050-1060 may have initial stress versus strain characteristics indicating relatively strong surface soil 1080. By interpolation, the initial stress versus strain characteristics for locations between soil columns 1005-1060 may be derived.

Figure 14:
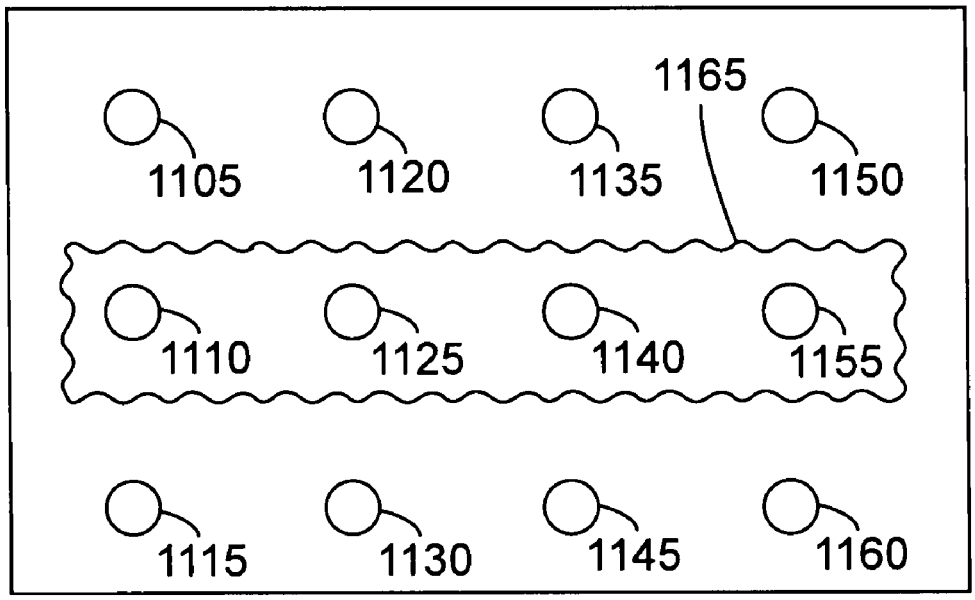
FIG. 14 illustrates a map of subsurface obstructions made according to another embodiment.

Likewise, referring to FIG. 14, the location of subsurface obstructions may be mapped by comparing the total deflection depths for soil columns 1105-1160, the final stress versus strain characteristics at the total deflection depth, and the initial stress versus strain soil characteristics. For example, soil columns 1105, 1120, 1135, 1150, 1115, 1130, 1145, and 1160 may have relatively similar total deflection depths, final stress versus strain characteristics at the total deflection depth, and initial stress versus strain soil characteristics. In contrast, soil columns 1110, 1125, 1140, and 1155 may have lesser total deflection depths, higher final stress versus strain characteristics at the total deflection depth, and a relatively similar initial stress versus strain soil characteristic. The differences between the values for the soil columns 1110, 1125, 1140, and 1155 and the values for the soil columns 1105, 1120, 1135, 1150, 1115, 1130, 1145, and 1160 may indicate a subsurface obstacle 1165 such as a log or remnants of a previous foundation where the soil columns 1110, 1125, 1140, and 11 55 are located.

As should be appreciated in view of the teachings herein, certain embodiments may achieve certain advantages, including by way of example and not limitation one or more of the following. Embodiments may provide a tamping apparatus with a confinement/surcharge ring for compacting soil in-place and reducing the likelihood that soil adjacent the compacted soil will loosen. Other embodiments may provide an apparatus and method that generates a relatively high level of dynamic impact energy so that the depth of compaction influence may extend several feet below the ground surface, and possibly further below the ground surface than traditional compaction equipment. Other embodiments may provide a method and apparatus for producing a pre-stressed soil column in-situ in the ground that is capable of supporting higher compression loads than adjacent unstressed soil, and in conjunction with surrounding unstressed soil, effectively reduces compression settlement of the composite layer to a magnitude that is less than would otherwise occur without the presence of the soil columns.

Still other embodiments may provide an apparatus and method that applies a dynamic force at a cyclic rate that is slower than vibratory compactors that are commonly used in construction to achieve a depth of compaction without undesirable vibration effects on nearby structures or vibration sensitive equipment. Further embodiments may provide an apparatus and method for determining a point at which additional application of the compaction impact force produces un-needed additional compaction.

Other embodiments may provide an economical, rapid method for identifying and mapping the horizontal extent of relatively weak surface soils, such as soft soil layers, and hard obstructions that are not apparent from visual surface inspection, such as old buried concrete structures left over from previous construction on the site.

Certain embodiments may provide a method for efficiently determining, in the field, the magnitude of the impact force delivered by the energy source so that, in combination with the deflection-monitoring device, a quantification of impact stress versus deflection may be obtained. Other embodiments may provide a method and apparatus for determining the stress versus strain characteristics of a soil column during its construction so that later verification testing of the changed stress versus strain characteristics achieved is not necessary.

Certain embodiments may provide an apparatus and method that strengthens loose or weak soils in-situ by pre-stressing the soil in-place to form a column of denser/stiffer soil, without the need for pre-excavating a cavity, and without the need for using natural resources such as gravel, crushed stone, cement, or chemicals. Other embodiments may provide a method of shallow sub-grade improvement that reduces an overall impact on the environment than any presently available method of shallow sub-grade improvement by requiring only one piece of construction equipment so as to reduce fuel consumption and exhaust emissions, by using soils already on the site so no imported aggregate is needed, by requiring no water, and by not disturbing groundwater.

The terms and descriptions used herein are set forth by way of illustration only and are not meant as limitations. Those skilled in the art will recognize that many variations can be made to the details of the above-described embodiments without departing from the underlying principles of the invention. The scope of the invention should therefore be determined only by the following claims (and their equivalents) in which all terms are to be understood in their broadest reasonable sense unless otherwise indicated.

The invention claimed is:

1. An apparatus for constructing soil columns comprising:

an energy source mechanically coupled to an impact foot to deliver an impact force to the impact foot and cause a displacement of the impact foot into ground on which the impact foot rests;

wherein the impact foot has a soil engaging foot surface, and a first pressure is applied to the ground by the soil engaging foot surface in response to the impact force;

a deflection monitoring device connected to the apparatus to measure the displacement of the impact foot; and a surcharge ring adjacent the impact foot, the surcharge ring having a soil engaging ring surface and a mass to exert a second pressure on the ground by the soil engaging ring surface.

2. The apparatus according to claim 1, wherein the second pressure is at least 10 percent of the first pressure.

3. The apparatus according to claim 1, wherein the surcharge ring does not contact the impact foot when the apparatus is used to construct a soil column, and a greatest distance between the surcharge ring and the impact foot is approximately one inch.

4. The apparatus according to claim 1, wherein the deflection monitoring device is configured to determine when a desired compaction is attained.

5. The apparatus according to claim 4, wherein the deflection monitoring device is further operably connected to the energy source to send a signal to the energy source to stop further delivery of the impact force in response to determining that the desired compaction is attained.

6. The apparatus according to claim 1, further comprising a signal processor operably connected to the deflection monitoring device to determine when a desired compaction is attained.

7. The apparatus according to claim 6, wherein the signal processor is a computer.

8. The apparatus according to claim 6, wherein the signal processor is further operably connected to the energy source to send a signal to the energy source to stop further delivery of the impact force in response to determining that the desired compaction is attained.

9. The apparatus according to claim 6, wherein the signal processor is further configured to display the deflection measured by the deflection monitoring device.

10. A surcharge ring for use in constructing soil columns comprising:

an outer portion; and an inner portion defined by a central aperture;

wherein the central aperture is sized to tightly receive an impact foot for applying a first pressure to the ground in response to an impact; and wherein the surcharge ring applies a second pressure to the ground that is at least 10 percent of the first pressure.

11. The surcharge ring according to claim 10, wherein the outer portion is located from the center of the central aperture between 1.5 to 2 times the distance from the center of the central aperture to the inner portion.

12. The surcharge ring according to claim 11, wherein the outer portion is located from the center of the central aperture 1.67 times the distance from the center of the central aperture to the inner portion.

13. The surcharge ring according to claim 10, wherein the surcharge ring exerts more pressure on the ground proximate the inner portion than proximate the outer portion.

14. The surcharge ring according to claim 13, further comprising a hollow cavity proximate the outer portion.

15. The surcharge ring according to claim 14, further comprising a fill opening communicating the hollow cavity with the atmosphere surrounding the surcharge ring and a drain opening communicating the hollow cavity with the atmosphere surrounding the surcharge ring.

16. The surcharge ring according to claim 13, further comprising a first channel proximate the inner portion and a second channel proximate the outer portion; and a first annular ring that detachably fits in the first channel and a second annular ring that detachably fits in the second channel.

17. The surcharge ring according to claim 13, wherein the second pressure is exerted by the surcharge ring in a radial direction from the inner portion to the outer portion for a distance approximately equal to one third the distance from the center of the central aperture to the inner portion, and a third pressure that is half of the second pressure is exerted by the remaining radial portion of the surcharge ring.

18. The surcharge ring according to claim 10, further comprising a plurality of attachment points secured to the surcharge ring for lifting the surcharge ring.

19. A method for constructing a soil column comprising:

placing a soil engaging foot surface of an impact foot on ground where the soil column will be constructed;

mechanically coupling the impact foot to an energy source to deliver an impact force to the impact foot, wherein the impact force causes the impact foot to apply a first pressure to the ground where the soil column will be built;

applying a second pressure, wherein the second pressure is applied to ground surrounding the ground where the soil column will be built; and after applying the second pressure, applying the first pressure by impacting the impact foot with the impact force from the energy source.

20. A method for constructing a soil column according to claim 19, further comprising:

determining a first pressure based on an area of the soil engaging foot surface and the impact force; and wherein applying a second pressure includes applying the second pressure at a level that is at least 10 percent of the first pressure.

21. A method for constructing a soil column according to claim 19, further comprising:

determining a deflection of the impact foot into the ground where the soil column will be constructed resulting from impacting the impact foot with the impact force from the energy source; and determining whether to apply the first pressure again based on the determined deflection of the impact foot.

22. A method for constructing a soil column according to claim 19, wherein applying the second pressure is accomplished by arranging a plurality of items around the impact foot.

23. A method for constructing a soil column according to claim 19, wherein applying the second pressure is accomplished by placing a surcharge ring around the impact foot.

* * * * *

UNITED STATES PATENT AND TRADEMARK OFFICE

CERTIFICATE OF CORRECTION

PATENT NO. : 7,931,424 B2
APPLICATION NO. : 12/485825
DATED : April 26, 2011
INVENTOR(S) : John Paul Martin, Sr.

It is certified that error appears in the above-identified patent and that said Letters Patent is hereby corrected as shown below:

Title Page, at (73), replace “Goundation” with --Foundation--.

In column 13, line 16, replace “11 55” with --1155--.

Signed and Sealed this
Seventh Day of June, 2011

David J. Kappos
*Director of the United States Patent and Trademark Office*